US006511946B1

(12) United States Patent
Theis et al.

(10) Patent No.: US 6,511,946 B1
(45) Date of Patent: Jan. 28, 2003

(54) WATER-MISCIBLE COOLING LUBRICANT CONCENTRATE

(75) Inventors: Heinz Gerhard Theis, Westheim (DE); Rüdiger Schwab, Gorxheimertal (DE)

(73) Assignee: Fuchs Petrolub AG, Mannheim (DE)

( * ) Notice: Subject to any disclaimer, the term of this patent is extended or adjusted under 35 U.S.C. 154(b) by 0 days.

(21) Appl. No.: 09/744,592

(22) PCT Filed: Jun. 10, 1999

(86) PCT No.: PCT/EP99/03990

§ 371 (c)(1),
(2), (4) Date: Mar. 12, 2001

(87) PCT Pub. No.: WO00/06675

PCT Pub. Date: Feb. 10, 2000

(30) Foreign Application Priority Data

Jul. 28, 1998 (DE) ..... 198 33 894

(51) Int. Cl.[7] ..... C10M 173/00

(52) U.S. Cl. ..... 508/195; 508/196; 508/514; 508/517; 508/552; 72/42

(58) Field of Search ..... 508/195, 196, 508/514, 517

(56) References Cited

U.S. PATENT DOCUMENTS

| | | | | | |
|---|---|---|---|---|---|
| 3,719,598 | A | * | 3/1973 | King | 508/195 |
| 3,969,236 | A | * | 7/1976 | Waldstein | 508/195 |
| 4,022,713 | A | * | 5/1977 | Waldstein | 508/195 |
| 4,176,076 | A | | 11/1979 | Waldstein | 252/49.6 |
| 4,226,734 | A | * | 10/1980 | Schuster | 508/194 |
| 4,303,540 | A | * | 12/1981 | Schuster | 508/194 |
| 4,384,965 | A | * | 5/1983 | Hellsten | 508/431 |
| 4,609,531 | A | * | 9/1986 | Ritschel et al. | 508/514 |
| 4,654,155 | A | | 3/1987 | Kipp et al. | 252/32.5 |
| 4,778,614 | A | * | 10/1988 | Rawlinson et al. | 508/195 |
| 5,055,231 | A | * | 10/1991 | Hadamik et al. | 508/195 |
| 5,068,422 | A | * | 11/1991 | Balzer et al. | 508/517 |
| 5,282,987 | A | * | 2/1994 | Balzer et al. | 508/517 |
| 5,399,274 | A | * | 3/1995 | Marcus | 508/195 |
| 5,512,191 | A | * | 4/1996 | Krueger | 508/250 |
| 5,668,093 | A | * | 9/1997 | Kremer et al. | 508/514 |
| 5,869,436 | A | * | 2/1999 | Lindman | 508/514 |
| 5,922,745 | A | * | 7/1999 | McCarthy et al. | 514/372 |
| 5,935,914 | A | * | 8/1999 | Theyssen et al. | 508/517 |
| 6,004,909 | A | * | 12/1999 | Lindman | 508/514 |
| 6,040,280 | A | * | 3/2000 | Kelly et al. | 508/517 |
| 6,242,391 | B1 | * | 6/2001 | Fukutani et al. | 508/180 |
| 6,258,759 | B1 | * | 7/2001 | Futahashi et al. | 508/143 |

FOREIGN PATENT DOCUMENTS

| | | |
|---|---|---|
| DE | 12 31 375 | 12/1966 |
| DE | 18 11 060 | 7/1969 |
| DE | 42 29 848 | 3/1994 |
| EP | 0 249 162 | 12/1987 |
| EP | 0 332 897 | 9/1989 |
| WO | 93/10105 | 5/1993 |
| WO | 99/23281 | 5/1999 |

* cited by examiner

*Primary Examiner*—Ellen M. McAvoy
(74) *Attorney, Agent, or Firm*—Wenderoth, Lind & Ponack, L.L.P.

(57) ABSTRACT

Described is a water-miscible cooling lubricant concentrate which comprises natural or synthetic mineral oils, emulsifying agents, corrosion protection additives, solubilizers, means of preservation, metal inhibitors and other conventional additives, and, after dilution to form a 2 to 25% by weight aqueous solution, has a pH value between 7.0 and 7.5 as well as additionally as means of preservation and/or anticorrosive additive comprises a mixture of a) a conversion product of boric acid and a primary or tertiary alkanolamine and/or b) an ethoxylated and/or propoxylated fatty acid or a fatty acid alkanolamide as well as at least one further compound selected from the group comprised of c) a carboxylic acid imide, a phosphoric acid ester, a triazole, a thiadiazole, an isothiazolinone, an imidazole, a guanidine, an aromatic carboxylic acid and the 3-iodo-2-propinyl-carbamate and/or d) a methylol urea derivative.

13 Claims, No Drawings

WATER-MISCIBLE COOLING LUBRICANT CONCENTRATE

This application is a 371 of PCT/EP99/03990 filed Jun. 10, 1999.

Subject matter of the invention is a water-miscible cooling lubricant concentrate which mixed with water is distinguished by excellent functional properties in metal cutting and non-cutting metal working as well as also through its especially high cutaneous tolerance.

According to information by the Arbeitsgemeinschaft der Metallberufsgenossenschaften cooling lubricants are involved in nearly 40% of the causes of occupational skin diseases in the industrial field (Brochure ZH 1/467, Hautschutz in Metallbetrieben, Arbeitsgemeinschaft der Metallberufsgenossenschaften, 1996).

Cooling lubricants are employed in metal cutting and in metal forming for the cooling and lubricating of workpieces. They are applied in the case of cutting working processes such as milling, turning, drilling and grinding as well as also in the case of non-cutting forming such as rolling, deep-drawing or cold impact forming. According to DIN 51385 one differentiates between water-miscible and water-mixed cooling lubricants. By the term "water-mixed" is understood the final state of the ready medium, most frequently in the form of an oil-in-water emulsion, and by "water-miscible" is understood the concentrate of the cooling lubricant.

Water-mixed cooling lubricants are produced by the user by mixing the concentrate with water. As an emulsion, solution or also in concentrated form its main purpose in metal working is the cooling, the lubrication and the dispersal away from the workpiece and tool of removed material generated by the multiplicity of production operations such as turning, drilling, milling, grinding etc. In addition, the water-mixed cooling lubricant meets a multiplicity of further secondary tasks, such as keeping free of debris the systems and lending [anti]corrosion protection to the machine parts.

Depending on the application concentration and the type of cooling lubricant, conventionally used water-mixed cooling lubricants have a pH value between 8.2 and 9.4, which only in exceptional cases can be still higher. Of disadvantage is that a high pH value lowers the cutaneous tolerance of the cooling lubricant since the protective acidic envelope of the skin is thereby destroyed and with relatively long exposure times the operator of the metal processing machine may develop skin problems. Lowering the pH value of water-mixed cooling lubricants to the point of neutrality has so far been found to be impossible since in that case the high requirements made of the rust inhibition effect of water-mixed cooling lubricants can no longer be met. After the working in cooling lubricants, it is generally not customary for reasons of economy, or due to the linking of fabrication processes, to dry the worked metal part or to provide it with a special corrosion protection. The parts are normally placed into boxes while wet and must thus also not rust in the wet state. For testing the effect of the rust protection during development and also while checking the water-mixed cooling lubricants, in general the test is performed using cast-iron turnings according to DIN 51360-1 and -2. This test demonstrates that the danger of rust formation on the worked metal part is greater the further the pH value of the water-mixed cooling lubricant shifts away from the alkaline in the direction toward the neutral pH range.

The task was therefore posed of providing a water-mixed cooling lubricant whose pH value is as close as feasible to the neutral point and nevertheless does not lead to the formation of rust on metal parts which had been worked with an aqueous solution of the cooling lubricant.

This task is solved through a water-miscible cooling lubricant concentrate which comprises natural or synthetic mineral oils, emulsifying agents, corrosion protection additives, solubilizers, means of preservation, metal inhibitors and other conventional additives and which, after dilution to form a 2 to 25% by weight aqueous solution, has a pH value between 7.0 and 7.5 as well as, additionally, as means of preservation and/or corrosion protection additive comprises a mixture of a) a conversion product of boric acid and a primary or tertiary alkanolamine and/or b) an ethoxylated and/or propoxylated fatty acid or a fatty acid alkanolamide as well as at least one further compound selected from the group comprised of c) a carboxylic acid imide, a phosphoric acid ester, a triazole, a thiadiazole, an isothiazolinone, an imidazole, a guanidine, an aromatic carboxylic acid and the 3-iodo-2-propinyl-carbamate and/or d) a methylol urea derivative.

Such a cooling lubricant concentrate comprises as the natural or synthetic mineral oils paraffinic or naphthenic hydrocarbons, which can also be mixed in quantitative proportions of 1:3 to 5:1, white oils, esters, polyisobutenes, polyvinylpyrrolidones or polyalkylene glycols. These compounds, also referred to as base oils, are generally comprised in proportions of 5 to 80% by weight, preferably in proportions of 5 to 50% by weight in the cooling lubricant concentrate.

Among the additives which must be worked into the base oil, the emulsifying agents represent the most important group in the production of the cooling lubricant concentrate according to the invention. Especially anionic emulsifying agents such as alkali salts of saturated or unsaturated carboxylic acids, alkali salts of sulfonates and sulfonic acids as well as salts of phosphoric acid esters have a highly specific significance. But, in addition, also used with success are non-ionic emulsifying agents, especially fatty alcohol ethoxylates, fatty, alcohol propoxylates, sugar esters, neopentyl glycol esters, pentaerythritol esters, 2-ethyl hexyl esters and trimethylolpropane esters for the production of the water-miscible cooling lubricant concentrate.

Of particular significance is the selection of suitable corrosion protection means. Neutral conversion products of boric acid with primary or tertiary alkanolamines as well as ethoxylated or propoxylated acids or fatty acid alkanolamides have been found to be particularly useful. By using boric acid compounds, moreover, the cooling lubricant biostasis and the buffering capacity can be increased. In practice, higher service life of the cooling lubricant is attained and consequently its economy it improved. The markedly increased biocidal activity of boric acid compounds, which is primarily observed in the low pH range and which can be explained by the enzymes of the phosphate metabolism of the microorganisms being blocked, permits, in addition, reducing the inhibitors against the growth of microorganisms to be added. Surprisingly, the corrosion protection of boron compounds is considerably increased if they are used together with polyalkoxylated fatty acid amides and/or imides, especially with neutral ethoxylated and/or propoxylated fatty acid amides based on plant and/or animal origin and/or specifically adjusted fatty acid mixtures and/or alkyl succinimides or with other corrosion protection additives, comprised also in conventional cooling lubricant formulations, for example phosphoric acid esters, triazoles or thiadiazoles, wherein the corrosion protection means is to be added in proportions of 5 to 25% by weight. A water-mixed cooling lubricant provided with said corrosion protection additives, even at a pH value between 7.0 and 7.5 in aqueous solution, shows a corrosion protection which is equivalent according to DIN 51360-1 and -2 to the cooling lubricants used up to now. If formulations free of boric acid are employed, which comprise ethoxylated and/or propoxylated fatty acid alkanolamides, a concentration of 2 to 25% by weight suffices to attain a corrosion protection which meets the most stringent demands made up to now of cooling lubricants. If, as the corrosion protection means fatty acids, in particular ether carboxylic acids, are used, an ethoxylation degree of 2 to 12 mole ethylene oxide per mole of ether carboxylic acid is especially advantageous. Such ethoxylated ether carboxylic acids are employed as anticorrosion means in concentrations of 2 to 15% by weight.

It has furthermore been found that through the low pH value and the selection of the base emulsifying agents and corrosion protection additives necessitated thereby, biocidal compounds, otherwise not provided with satisfactory stability, retain a stability of the active substance of markedly greater than 95% even under long storage times and increased temperature. Among these compounds are counted primarily 3-iodo-2-propinyl-butylcarbamate, methylisothiazolinone and other isothiazolinone derivatives.

Based on the problematic that in particular secondary alkanolamines and their derivatives when applied in practice with nitrosating substances such as nitrite, which is formed through bacterial activity from the nitrate of the mixture water, react to form carcinogenic nitrosamines, and whose formation takes place as a function of the pH value in particular in the acidic range, particular attention should be paid to the pH range from 7.0 to 7.5. As tests have shown, the nitrosamine formation can be prevented by using inhibitors. As such inhibitors act, inter alia, free primary amines, which in small proportions are formed in the cooling lubricant according to the invention, due to a dissociation equilibrium, from fatty acid alkanolamides, or, for example, ascorbic acid. The nitrosamine formation is thereby prevented. Against an increased risk of nitrosamine formation of the cooling lubricant formulations according to the invention speak also test results, [indicating] that in particular amides cannot form stable nitrosamines in the pH range of 6 to 8.

The active substances comprised in the cooling lubricant concentrate according to the invention can only then develop their optimum effect if they are distributed homogeneously and the cooling lubricant concentrate does not separate into several phases. For that reason, solubilizers must be added to the concentrate. Apart from water, glycols, such as ethylene glycol and especially butyltriglycol, are suitable for this purpose, in addition also straight-chain and branched fatty alcohols with 16 to 24 carbon atoms, if they are added in proportions of 5 to 50% by weight.

In general the water-mixed cooling lubricant is a good nutrient medium for microorganisms. Increased contamination with bacteria, fungi and yeasts leads to chemical changes of the emulsion components and affects the usability of the water-mixed cooling lubricant. If microorganisms injurious to health are introduced, for example coliform bacteria, serious effects on the health of the workers may result. For this reason providing the cooling lubricant concentrate with corresponding biocidal or fungicidal compounds is most frequently indispensable.

It has been found that with the formulations according to the invention components, which are otherwise customarily not found in the cooling lubricant concentrate, such as isothiazolinones or 3-iodo-2-propinyl carbamate have an interesting and economical spectrum of activities such as were previously unknown. As a further, especially suitable, means of preservation, taking into account the pH value of <7.6, should be listed especially guanidine derivatives, imidazole derivatives and aromatic carboxylic acids such as salicylic or benzoic acid and their derivatives. By employing them in the formulations according to the invention with a pH value of 7 to 7.5 it was surprisingly found that methylol urea derivatives such as dimethylol urea and/or tri- and tetramethylol acetylene diurea, counter to previous experience, do not polymerize through to form ineffective polyurea derivatives even in relatively high concentrations and subsequently are thus not longer available as biocidal agent or cause problems due to precipitation reactions and inhomogeneities. The means of preservation are in general added to the cooling lubricant concentrate in proportions of 0.1 to 5% by weight.

The water-miscible and water-mixed cooling lubricants according to the invention can comprise further functional additives, for example castor oil ethoxylates, petroleum sulfonates up to a total base number of ≦400, solid lubricants, toluyl triazoles, antifoaming agents and/or antifogging additives. In general, for the application in metal working the aqueous solutions or emulsions produced from the water-miscible cooling lubricant concentrate comprise these additives in proportions of 1 to 10% by weight, preferably in proportions of 2 to 5% by weight, relative to the water-miscible cooling lubricant concentrate.

Measurement of the transepidermal water loss (TEWL) has today become established as a field-tested criterion for assessing the effect of a cooling lubricant on the deterioration of the barrier function of the skin. Therein is measured the quantity of water per unit time and area diffused from the inside to the outside through the skin. High TEWL values indicate high water loss and consequently a deterioration of the barrier function, low TEWL values indicate an intact barrier function. As the reference medium is used water and the highly aggressive sodium dodecyl sulfate (SDS). The cooling lubricant is conventionally tested in the concentration required for its use, most often 5% by weight or 10% by weight. If it is taken into account that the cooling lubricant can also become concentrated on the skin and in this case markedly exceeds the application/test concentration, higher test concentrations are obvious, but are not carried out since critical values are to be expected.

By testing formulations according to the invention with a pH value of 7 to 7.5 it has now been demonstrated by means of TEWL measurements that the cooling lubricant in a test concentration of 100% by weight can be classified as non-irritating.

The water-miscible cooling lubricant concentrate was produced according to the following formulation examples.

EXAMPLE 1

| Semisynthetic boron-containing cooling lubricant concentrate | |
|---|---|
| Paraffinic hydrocarbon | 30% |
| Boric acid alkanolamine ester/amide mixture | 20% |
| Tall oil fatty acid | 5% |
| C16/C18 fatty acid alkanolamide | 11% |
| Oleylether carboxylic acid (degree of ethoxylation 9) | 3% |
| Trimethylolpropane - trioleate | 16% |
| $C_{16}$ Guebert alcohol | 5% |
| Methylisothiazolinone | 0.5% |
| 3-iodo-propinyl butyl carbamate (IPBC) | 0.5% |
| Water | 9% |

EXAMPLE 2

| Semisynthetic boron-containing cooling lubricant | |
|---|---|
| Refined paraffinic solvent | 24% |
| Reaction product of boric acid-triethanolamine | 25% |
| Fatty acid monoethanolamide (degree of ethoxylation 4) | 12% |
| Alkyl succinimide | 4.5% |
| Castor oil ethoxylate (degree of ethoxylation 5) | 3% |
| Synthetic sodium petroleum sulfonate | 5% |
| Ethylene propylene glycol | 4.3% |
| Poiypropylene glycol monobutylether | 2% |
| Ethylhexyloleate | 16% |
| Hexitidine | 3.5% |
| 3-iodo-2-propinyl butyl carbamate | 0.5% |

EXAMPLES 3a and 3b

| Semisynthetic boron-free cooling lubricant concentrate | |
|---|---|
| 3a) Medicinal white oil or | 42.5% |
| 3b) Trimethylolpropane adipate | 42.5% |
| KOH-saponified rape-seed oil | 25% |
| C16/C18 fatty acid alkanolamide (degree of ethoxylation 4) | 12% |
| Alkyl succinimide | 3.5% |
| Polypropylene glycol monobutylether | 5% |
| Synthetic sodium petroleum sulfonate (Petronate ®CR) | 4% |
| Coconut alkyl guanidinium derivative (Dodigen ®) | 1% |
| n-octylisothiazolinone | 0.6% |
| Methylol urea derivative | 2.5% |
| Water | 3.9% |

EXAMPLE 4

| Synthetic mineral oil-free cooling lubricant concentrate | |
|---|---|
| Triethanolamine salt of a cyclic tricarboxylic acid (Irgacor ® L 190) | 50% |
| Rape-seed oil fatty acid alkanolamide (degree of ethoxylation 4) | 2.5% |
| Phosphoric acid partial ester, neutralized with a primary alkanolamine | 7% |
| $C_{10}$ monocarboxylic acid (neodecanoic acid) | 3% |
| n-octyl isothiazolinone | 0.3% |
| Polymeric cationic microbiocide | 0.15% |
| Water | 37.05% |

Type characteristic values of the formulation examples according to the invention as 5% emulsion/solution

| Formulation Example | 1 | 2 | 3a | 3b | 4 |
|---|---|---|---|---|---|
| Appearance | coarsely dispersed/milky clear solution | | | | |
| pH value | 7.4 | 7.5 | 7.4 | 7.4 | 7.5 |
| Corrosion protection acc. to DIN 51 360-2 | | | | | |
| Rust rating 0 at | 4.5% | 4% | 4% | 4% | 3.5% |

We claim:

1. A water-miscible cooling lubricant concentrate comprising a natural or synthetic mineral oil, an emulsifying agent, a solubilizer, a metal inhibitor and a preservation and corrosion protection agent which comprises:

a) at least one component selected from the group consisting of an ethoxylated fatty acid, a propoxylated fatty acid, an ethoxylated fatty acid alkanolamide, a propoxylated fatty acid alkanolamide and a conversion product of boric acid with a primary or tertiary alkanolamine, and b) at least one component selected from the group consisting of a carboxylic acid imide, a phosphoric acid ester, a thiadiazole, an isothiazolinone, an imidazole, a guanidine, an aromatic carboxylic acid, 3-iodo-2-propinyl-carbamate and a methylol urea derivate, wherein when said concentration is diluted to form a 2 to 25% by weight aqueous solution, said aqueous solution has a pH between 7.0 and 7.5.

2. The water-miscible cooling lubricant concentrate according to claim 1, wherein said preservation and corrosion protection agent comprises:

$a_1$) at least one conversion product of boric acid with a primary or tertiary alkanolamine, and $a_2$) at least one ethoxylated fatty acid, propoxylated fatty acid, ethoxylated fatty acid alkanolamide or propoxylated fatty acid alkanolamide, and b) at least one component selected from the group consisting of a carboxylic acid imide, a phosphoric acid ester, a thiadiazole, an isothiazolinone, an imidazole, a guanidine, an, aromatic carboxylic acid, 3-iodo-2-propinyl-carbamate and a methylol urea derivate.

3. The water-miscible cooling lubricant concentrate according to claim 1, wherein said preservation and corrosion protection agent comprises:

a) at least one component selected from the group consisting of an ethoxylated fatty acid, a propoxylated fatty acid, an ethoxylated fatty acid alkanolamide, a propoxylated fatty acid alkanolamide and a conversion product of boric acid with a primary or tertiary alkanol mine, and $b_1$) at least one component selected from the group consisting of a carboxylic a id imide, a phosphoric acid ester, a thiadiazole, an isothiazolinone, an imidazole, a guanidine, an aromatic carboxylic acid and 3-iodo-2-propinyl-carbamate, and $b_2$) at least one methylol urea derivate.

4. The water-miscible cooling lubricant concentrate according to claim 1, wherein said preservation and corrosion protection agent comprises:

$a_1$) at least one conversion product of boric acid with a primary or tertiary alkanolamine, and $a_2$) at least one ethoxylated fatty acid, propoxylated fatty acid, ethoxylated fatty acid alkanolamide or propoxylated fatty acid alkanolamide, and $b_1$) at least one component selected from the group consisting of a carboxylic acid imide, a phosphoric acid ester, a thiadiazole, an isothiazolinone, an imidazole, a guanidine, an aromatic carboxylic acid and 3-iodo-2-propinyl-carbamate, and $b_2$) at least one methylol urea derivate.

5. The water-miscible cooling lubricant concentrate according to claim 1, wherein the natural or synthetic mineral oil comprises a paraffinic hydrocarbon, a naphthenic hydrocarbon, an ester, a polyisobutene, a polyvinyl pyrrolidone or a polyalkylene glycol in a proportion of 5 to 80% by weight.

6. The water-miscible cooling lubricant concentrate according to claim 1, wherein the emulsify agent is at least one anionic or non-ionic surfactant compound, and optionally as a co-emulsifying agent, one or more mono- or dicarboxylic acids with 16 to 54 carbon atoms or an alkali salt thereof in a proportion of 2 to 20% by weight.

7. The water-miscible cooling lubricant concentrate according to claim 1, wherein the solubilizer comprises water, ethylene glycol, butyltriglycol, and straight-chain or branched fatty alcohol with 16 to 24 carbon atoms in a proportion of 5 to 50% by weight.

8. The water-miscible cooling lubricant concentrate according to claim 1, further comprising a bactericidal and fungicidal active agent in a proportion of 0.1 to 5% by weight.

9. The water-miscible cooling lubricant concentrate according to claim 1, which further comprises at least one alkyl succinimide, castor oil ethoxylate, petroleum sulfonate, solid lubricant, toluyl triazole, antifoaming agent or antifogging additive.

10. A water-mixed cooling lubricant, which comprises the water-miscible cooling lubricant concentrate according to any one of claims 1 to 9 in a proportion of 2 to 25% by weight and water, having a pH value between 7.0 and 7.5.

11. A cooling lubricant comprising a natural or synthetic mineral oil, water, an emulsifying agent, a solubilizer, a metal inhibitor and a preservation and corrosion protection agent comprising:

a) at least one component selected from the group consisting of an ethoxylated fatty acid, a propoxylated fatty acid, an ethoxylated fatty acid alkanolamide, a propoxylated fatty acid alkanolamide and a conversion product of boric acid with a primary or tertiary alkanolamine, and b) at least one component selected from the group consisting of a carboxylic acid imide, a phosphoric acid ester, a thiadiazole, an isothiazolinone, an imidazole, a guanidine, an aromatic carboxylic acid, 3-iodo-2-propinyl-carbamate and methylol urea derivate, wherein said cooling lubricant is 75 to 98% by weight of water and has a pH of between 7.0 and 7.5.

12. A method for cooling or lubricating a metal cutting tool or metal working tool, which comprises applying an aqueous solution or emulsion of the water-miscible cooling lubricant concentrate according to any one of claims 1 to 9 to the metal cutting tool or metal working tool.

13. A method for producing a water-mixed cooling lubricant, which comprises diluting the water-miscible cooling lubricant concentrate according to any one of claims 1 to 9 in a proportion of 2 to 25% by weight with water to form an aqueous solution having a pH of between 7.0 and 7.5.

* * * * *